United States Patent [19]

Sjodahl

[11] Patent Number: 4,724,886

[45] Date of Patent: Feb. 16, 1988

[54] MOLD CAVITY MISALIGNMENT DETECTION SYSTEM

[75] Inventor: Eric J. Sjodahl, Valdese, N.C.

[73] Assignee: Selective Electronic, Inc., Valdese, N.C.

[21] Appl. No.: 934,783

[22] Filed: Nov. 25, 1986

[51] Int. Cl.[4] ..... B22C 11/08; B22C 13/00

[52] U.S. Cl. ..... 164/4.1; 164/150; 164/137; 164/339

[58] Field of Search ..... 164/150, 4.1, 456, 155, 164/137, 339

[56] References Cited

U.S. PATENT DOCUMENTS

| | | | |
|---|---|---|---|
| 2,591,314 | 4/1952 | Stelmach | 164/150 |
| 3,565,531 | 2/1971 | Kane et al. | 356/4 |
| 3,633,010 | 1/1972 | Svetlichny | 164/4.1 |
| 4,375,921 | 3/1983 | Morander | 356/4 |
| 4,453,083 | 6/1984 | Bohlander et al. | 164/451 |

FOREIGN PATENT DOCUMENTS

| | | | |
|---|---|---|---|
| 133865 | 10/1980 | Japan | 164/154 |
| 168747 | 10/1982 | Japan | 164/150 |
| 168749 | 10/1982 | Japan | 164/150 |

*Primary Examiner*—Nicholas P. Godici
*Assistant Examiner*—Samuel M. Heinrich
*Attorney, Agent, or Firm*—Bell, Seltzer, Park & Gibson

[57] ABSTRACT

An apparatus and method for detecting the misalignment of cooperating mold sections is provided. The apparatus and method utilize a mold making machine which includes a device for forming a cavity of predetermined shape in the interior of each mold section and a device for forming a reference mark on the exterior of the mold surface, a conveyor for transporting the molds along a predetermined path from the mold making machine to a mold pouring station, and a non-contact distance measuring device for detecting the misalignment of the internal mold cavities of the mold sections by detecting any misalignment in the external reference marks.

14 Claims, 6 Drawing Figures

MOLD CAVITY MISALIGNMENT DETECTION SYSTEM

BACKGROUND OF THE INVENTION

This invention relates to an apparatus and method useful in foundry operations for detecting the misalignment of cooperating sand mold sections. Particularly, this invention relates to the use of a non-contact distance measuring device, located adjacent to the path of travel of the mold sections, to detect the misalignment of the internal cavities of the mold sections.

Typically, in foundry operations, sand mold sections must remain aligned in order to produce a correctly formed molded article when the mold cavity is filled. If the mold sections should become misaligned due to difficulties in the formation of the mold sections, or in the transporting or filling processes, the end product will be improperly formed and unuseable. The problem in detecting this misalignment is that the cooperating mold sections typically give no outward visual indication of misalignment as they are advanced from the mold making machine to the mold pouring station, even when in actuality the internal mold cavities may be misaligned. The only way to currently detect any misalignment of the mold cavity is to wait and check the molded end product for any alignment errors, and this delay in finding an error often results in a great and expensive waste, inasmuch as the end product can only be checked after a number of mold sections, all possibly misaligned, have been filled and transported to the end of the foundry production line. The present invention eliminates the necessity of waiting until the end of the production line and the possible waste by determining, while the mold section advances both to and from the mold pouring station, whether the hidden internal mold cavity is aligned properly by employing a non-contact distance measuring device to detect the misalignment.

Non-contact distance measuring devices such as devices utilizing lasers, have been employed in a variety of manufacturing and industrial applications. Laser measuring devices, for example, have been used for such diverse applications as measuring fluid levels in bottles, performing quality control of machine parts, measuring the thickness of steel slabs, and numerous other areas wherein the flucuation of the distance to the surface of an object as it passes beneath a laser beam can be measured and correlated to a desired property or dimension of that article. Exemplary systems utilizing non-contact distance measuring devices in manufacturing applications are disclosed in U.S. Pat. No. 3,565,531 to Kane et al, U.S. Pat. No. 3,633,010 to Svetlichy, U.S. Pat. No. 4,375,921 to Morander and U.S. Pat. No. 4,453,083 to Bohlander et al. However, these systems have not utilized the distance measuring device in a foundry system to detect mold cavity misalignment.

It is, therefore, an object of the present invention to provide an apparatus and method for detecting mold section misalignment which employs a non-contact distance measuring device to detect the misalignment of internal mold cavities of the mold sections. Other objects and advantages of the invention will be particularly identified below.

SUMMARY OF THE INVENTION

Generally in a foundry operation utilizing sand molds, it is critical that the cooperating mold sections remain aligned throughout the formation of the mold sections and the transporting and filling processes in order to properly form the internal mold cavity formed by the cooperating mold sections, so as to produce a properly formed end product. In accordance with the present invention, an apparatus and method for detecting the misalignment of the internal cavities of the mold sections is provided. The apparatus and method utilizes a mold making machine which includes a device for forming a cavity of predetermined shape in the interior of each mold section and a device for forming a reference mark on the exterior of the mold section surface. The reference mark is located in a predetermined fixed distance relationship with respect to the internal mold cavity and thus gives an external indication of the location of the internal cavity. When two adjacent mold sections are properly assembled in cooperating relationship, the external reference marks of the two adjacent mold sections will also be in alignment. A conveyor is provided for transporting the mold sections along a predetermined path from the mold making machine to a mold pouring station, and past a non-contact distance measuring device. The non-contact distance measuring device detects misalignment by measuring the distance to an area on the exterior surface of the mold section where the reference marks are located. If an internal misalignment exists, the reference marks will also be misaligned, and this misalignment will be detected as a step change in the measured distance to the reference marks.

DETAILED DESCRIPTION OF THE INVENTION

The present invention now will be described more fully hereinafter with reference to the accompanying drawings, in which preferred embodiments of the invention are shown. This invention can, however, be embodied in many different forms and should not be construed as limited to the embodiments set forth herein; rather, applicants provide these embodiments so that this disclosure will be thorough and complete, and will fully convey the scope of the invention to those skilled in the art.

Figure 1:
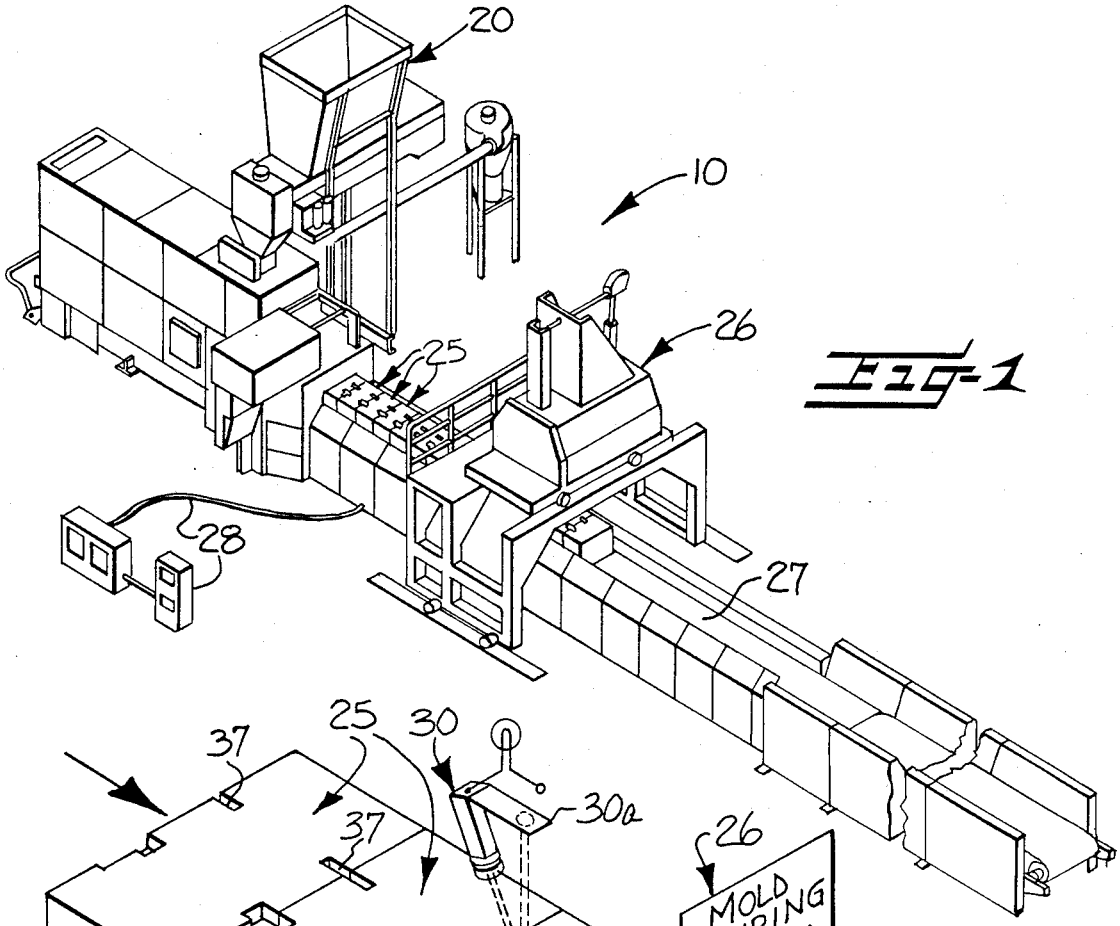
FIG. 1 is a perspective view of a foundry production line.

FIG. 1 discloses the basic foundry production line system, generally indicated by the reference numeral 10, employed in the embodiments of the present invention. The basic system 10 is comprised of a sand mold making machine 20 for forming cooperating molds sections 25, a conveyor 27, a mold pouring station 26 where the molten metal is dispensed, and a system control unit 28. The cooperating mold sections 25 are formed by the mold making machine 20, conveyed along a predetermined path from the mold making machine 20 to a mold pouring station 26, and scanned by a non-contact distance measuring device 30 located adjacent the path of travel of the mold sections 25. The step of scanning can be performed before and/or after the mold is filled. Turning now to the specific aspects of detecting misalignment of the internal cavities of the molds sections 25, the present apparatus and method will be discussed in detail hereinafter.

Figure 3:
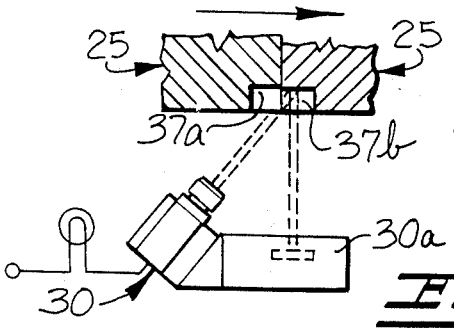
FIG. 3 is a partial side sectional view showing the non-contact distance measuring device detecting a step change in the distance to the reference mark.
Figure 4:
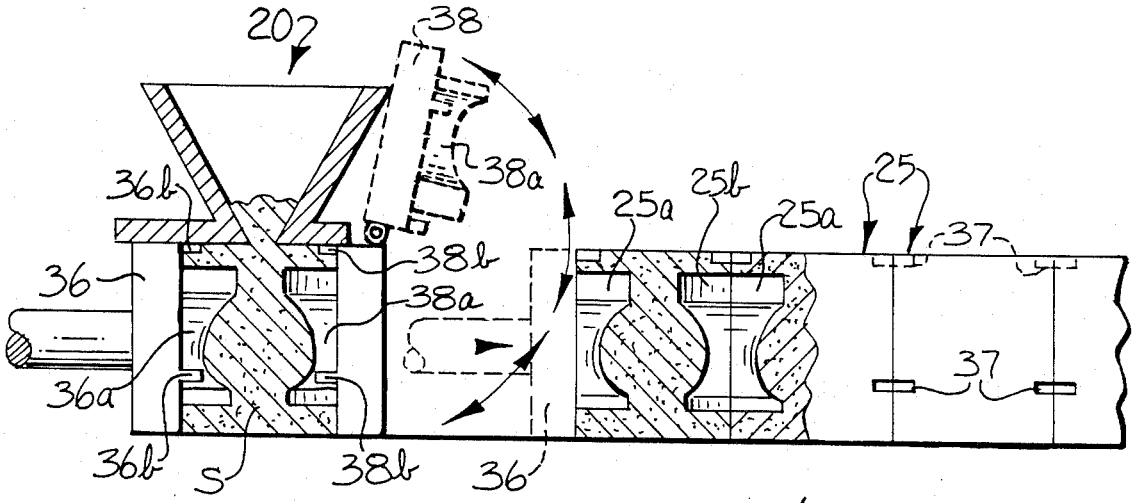
FIG. 4 is a sectional view showing the mold making machine including the devices for forming the mold cavity and for forming the reference marks.
Figure 5:
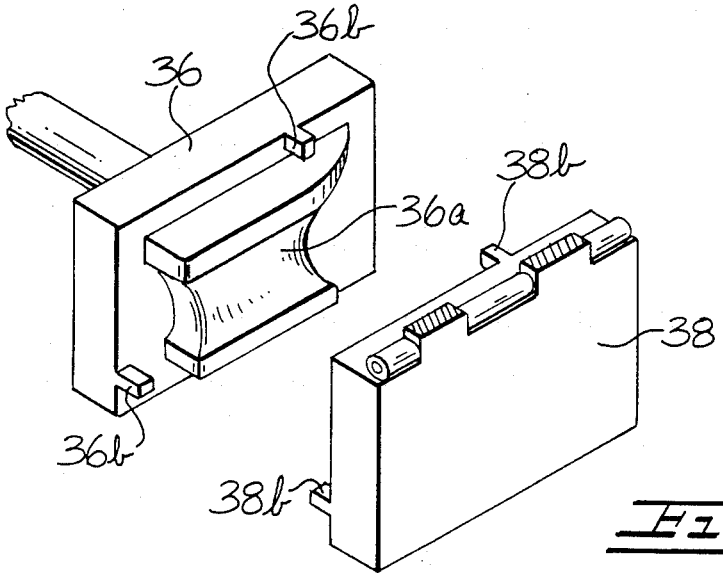
FIG. 5 is an enlarged perspective view of a reciprocable ram carrying a mold cavity die and a reference mark die and of a pivotable gate also carrying a mold cavity die and a reference mark die.

Referring now to FIGS. 4 and 5, the mold making machine 20 is a commercially available sand mold machine of the type commonly utilized by foundries. Sand is poured and compressed into the mold section 25 having the configuration S. The mold section configuration S is formed by a reciprocable ram 36 carrying a mold die **36*a* impressing a first mold cavity 25*a* into an interior portion of a trailing face of a mold section 25 and an upwardly pivotable gate 38 carrying a mold die 38*a* impressing the corresponding second mold cavity 25*b* into an interior portion of a leading face of the same mold section 25. The mold dies 36*a* and 38*b* are of convex shape corresponding to half of the desired configuration. Thus the mold section configuration S comprises a first mold cavity 25*a* in its trailing face and a second mold cavity 25*b* in its leading face with compressed sand between the two mold cavities 25*a*, 25*b*. The mold cavity 25*b* on the leading face of one mold section then comes in contact with a previously formed mold cavity 25*a* on the trailing face of the next adjacent mold section as the mold sections are advanced from the mold making machine 20 by the force of the ram 36. The two mold cavities 25*a* and 25*b* thus cooperate to form a whole mold cavity in the interior of each cooperating pair of mold sections 25. The cavity is in the shape of the desired end product, such as the anvil shown in FIGS. 2–5**.

The reciprocable ram 36 and the upwardly pivotable gate 38 also carry devices **36*b*, 38*b* for forming one or more reference marks 37 on the exterior trailing and leading faces of the mold sections 25. These devices 36*b*, 38*b* and reference marks 37 are in fixed distance relationship with respect to the mold dies 36*a*, 38*a* and to the internal mold cavities 25*a*, 25*b*, respectively. The marks 37 are typically rectangular in shape and about two to four inches long, about two inches deep and about two inches wide. When two adjacent mold sections are positioned with the internal cavities in proper alignment, the external reference marks of the two mold sections will also be in alignment. Any misalignment of the internal mold cavities will be evidenced by a step change in the depth of the cooperating reference marks, as shown in FIG. 3**.

Located adjacent to the path of travel of the mold sections 25 at a predetermined location downstream and/or upstream from the mold forming machine is a non-contact distance measuring device 30. The non-contact distance measuring device 30 generally utilizes an infrared light source such as an LED or a laser diode to create an illuminated spot on a surface, herein the surface of the mold 25. An optical sensor **30*a* associated with the measuring device 30** detects the position of the spot on the surface and thereby measures the distance to the surface of the object. Laser non-contact distance measuring devices of this type are known in the art and available commercially. One such suitable device is the OPTOCATOR TM, available from Selective Electronic Inc. of Valdese, N.C.

Figure 2:
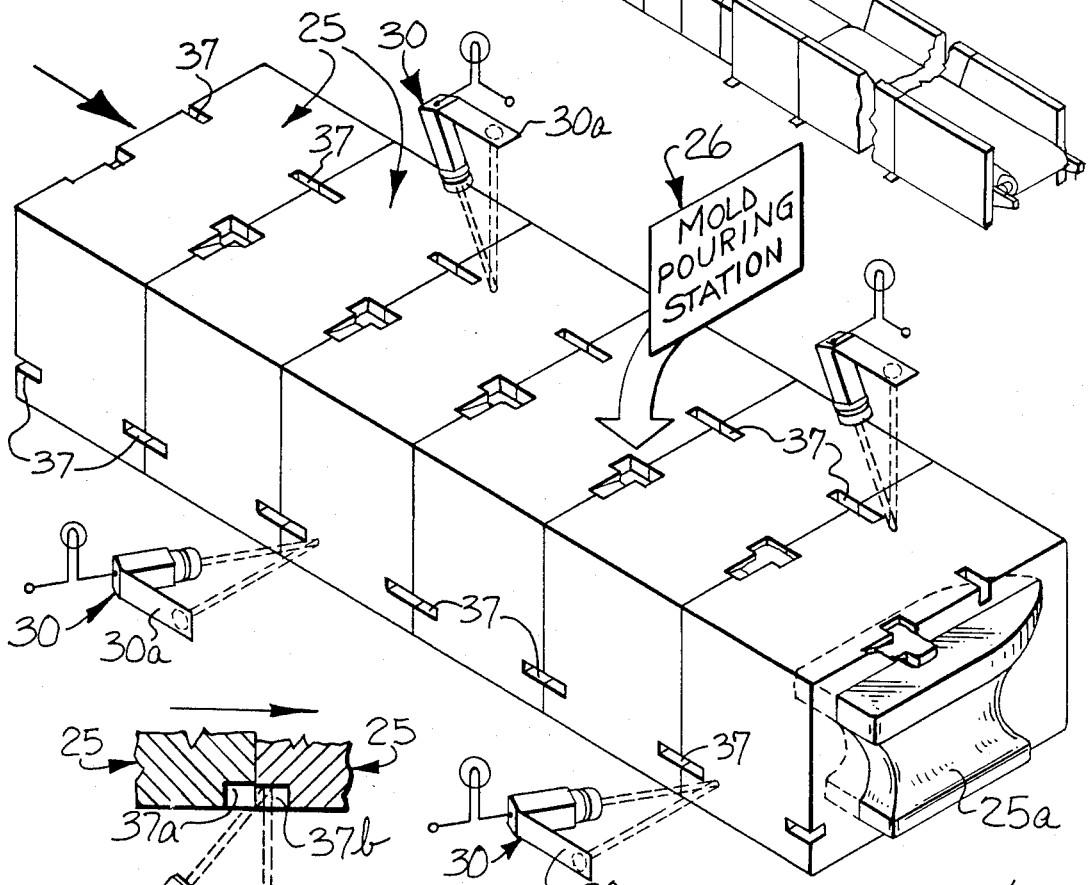
FIG. 2 is a sectional view showing in detail the mold sections and the non-contact distance measuring device scanning for the reference marks.
Figure 6:
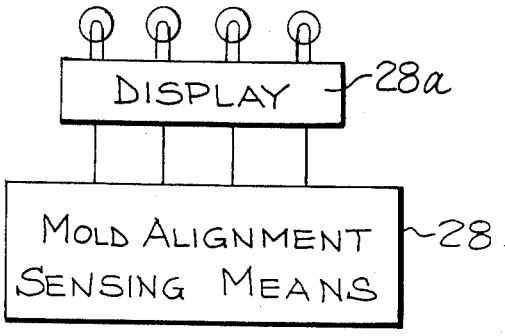
FIG. 6 is a schematic representation of a mold misalignment sensing device and a display device for warning an operator of the foundry production line of any misalignment.

Referring now to FIGS. 2 and 3, the manner in which the apparatus detects mold section 25 misalignment will be described. At a position downstream from the mold pouring station 26, the non-contact distance measuring device 30 is scanning the surfaces of the cooperating mold sections 25 attempting to locate the reference marks 37 as the mold sections are advanced along the conveyor. The distance measuring device 30 initially detects a step increase in the measured distance as the reference mark passes into the field of view of the measuring device 30. If, during the time that the reference mark is within the field of view, this distance changes in a stepwise manner in an amount greater than a previously established threshold tolerance, this indicates an internal misalignment and the operator is signaled, through a display **28*a* on the system control unit 28 such as schematically depicted in FIG. 6. The operator then has a choice of stopping the advancement of the mold sections 25 and correcting the problem causing the misalignment, or the operator may wait and see if the misalignment was an isolated problem or a persistent problem by checking several subsequent mold sections 25 for misalignment before stopping the production line. In order to detect both vertical, lateral and rotational misalignment, reference marks 37 are formed on at least two adjacent sides of the molds and at least two measuring devices 30** are provided at different locations for checking for misalignment from several different points of view. For example, two measuring devices may be positioned above the molds and a third device may be positioned on one side of the molds. In a further arrangement, one of the reference marks may be located at the corner of the mold block and two measuring devices may be focused at the same reference mark, one from above and one from the side, with a third measuring device being focused at a second reference mark elsewhere on the mold.

The same procedure of the distance measuring device 30 locating the reference mark 37, measuring the distance thereto and so forth can also be performed after the mold section 25 has been filled at the mold pouring station 26. At this location any shifts in the alignment of the mold section 25 which may have occured during or after pouring can be detected and again a signal given to the operator to correct any problems.

The foregoing embodiments are to be considered illustrative rather than restrictive of the invention, and those modifications which come within the meaning and range of equivalents of the claims are to be included therein.

That which I claim is:

1. An apparatus for detecting misalignment of cooperating mold sections comprising:

a sand mold making machine for forming a series of cooperating sand mold sections from compressed sand, said mold making machine including means for forming in a interior portion of the cooperating mold sections a mold cavity of a configuration corresponding to the desired shape of the article to be molded, and said mold making machine also including means for forming on the exterior surface of each corresponding mold section, reference marks which are located in predetermined fixed distance relationship with respect to the mold cavity formed in the mold section, with the reference marks formed in cooperating sand mold sections being located in cooperating alignment with one another on the exterior surface of the mold sections when the cooperating mold cavities are properly aligned;

means for conveying the cooperating mold sections along a predetermined path of travel from said mold making machine to a mold pouring station; and non-contact distance measuring means, located adjacent the path of travel of said mold sections and operable for measuring the distance to an area on the surface of the mold sections where said reference marks are located and for detecting step changes in the measured distance to the reference marks of cooperating mold sections so that misalignment of the internal mold cavity of the cooperating mold sections can be detected.

2. An apparatus according to claim 1 wherein said non-contact distance measuring means are located both prior to and after said mold pouring station.

3. An apparatus according to claim 1 wherein said non-contact distance measuring means includes means for transmitting a radiant energy beam toward and into contact with the surface of said molds and means for optically detecting the radiant energy beam on the surface of the mold.

4. An apparatus according to claim 3 wherein said means for transmitting a radiant energy beam comprises a laser.

5. An apparatus according to claim 1 including signal means operable for generating a signal to an operator when said non-contact distance measuring means detects misalignment of the internal mold cavities of the mold sections.

6. An apparatus according to claim 1 wherein said mold cavity is formed in a trailing face of a first mold section and in a leading face of a cooperating adjacent mold section and wherein said reference marks are formed at a trailing edge of the first mold section and at a leading edge of the cooperating adjacent mold section and are located in cooperating alignment with one another when the cooperating mold cavities are properly aligned.

7. An apparatus according to claim 1 wherein said reference marks are provided on two adjacent sides of each mold section.

8. An apparatus according to claim 1 wherein said mold making machine includes a reciprocable ram, and wherein said means for forming a mold cavity in an interior portion of each mold section and said means for forming a reference mark on the exterior surface of each mold section are both carried by said reciprocable ram.

9. An apparatus for detecting misalignment of cooperating sand mold sections comprising:

a sand mold making machine for forming a series of cooperating mold sections from compressed sand, said sand mold making machine including a reciprocable ram and a cooperating upwardly pivotable gate whihc are both adapted for forming, respectively, a mold cavity between the trailing face of a first mold section, wherein said ram and said pivotable gate carry a mold die means defining a convex formation thereon corresponding to the desired shape of the mold cavity to be formed in the mold sections and also carry a reference mark die means defining a rectangular shape and located so as to form the reference marks at predetermined, fixed distance relationship with respect to the mold cavity, with the reference marks formed in cooperating sand mold sections being located in cooperating alignment with one another on the exterior surface of the mold sections when the cooperating mold cavities are properly aligned;

means for conveying the cooperating mold sections along a predetermined path of travel from said mold making machine to a mold pouring station; and non-contact distance measuring means, located adjacent the path of travel of said mold sections and operable for measuring the distance to an area on the surface of the mold sections where said reference marks are located and for detecting step changes in the measured distance to the reference marks of cooperating mold section so that misalignment of the internal mold cavity of the cooperating mold sections can be detected.

10. A method for detecting misalignment of cooperating sand mold sections comprising:

forming a series of cooperating sand mold sections, said step of forming including forming in an interior portion of the cooperating mold sections a mold cavity of a configuration corresponding to the desired shape of the article to be molded, and said step of forming also including forming on the exterior surface of the corresponding mold sections, reference marks which are located in predetermined fixed distance relationship with respect to the mold cavity formed in the mold section, with the reference marks formed in cooperating sand mold sections being located in cooperating alignment with one another on the exterior surface of the mold sections when the cooperating mold cavitites are properly aligned;

conveying the cooperating mold sectiosn along a predetermined path of travel from a mold making machine to a mold pouring station; and measuring with a non-contact distance measuring means located adjacent the path of travel of the mold sections the distance to an area on the surface of the mold sections where the reference marks are located and detecting step changes in the measured distance to the reference marks of cooperating mold sections so that misalignment of the internal mold cavity of the cooperating mold sections can be detected.

11. A method according to claim 10 wherein said step of measuring the distance to an area on the surface of the mold sections is performed both prior to and after the mold sections have been conveyed to the mold pouring station.

12. A method according to claim 10 which includes the additional step of generating a signal to an operator in response to detecting the misalignment of the cooperating mold sections.

13. A method according to claim 10 wherein said step of forming a series of cooperating molds includes forming a mold cavity in a trailing face of a first mold section and in a leading face of a cooperating adjacent mold section and also including forming a reference mark on a trailing edge of the first mold section and at a leading edge of the cooperating adjacent mold section, the reference marks located in cooperating alignment with one another when the cooperating mold cavities are properly aligned.

14. A method for detecting misalignment of cooperating sand mold sections comprising:

forming a series of cooperating mold sections from compressed sand, said step of forming including forming a mold cavity in the trailing face of a first mold section and in the leading face of the next successive mold section, with the mold cavities of the adjacent mold sections cooperating to form an internal mold cavity of a desired configuration, and while also forming on the exterior surface of each mold section a reference mark located in predetermined fixed distance relationship with respect to the mold cavity, with the reference marks formed in cooperating sand mold sections being located in cooperating alignment with one another on the exterior surface of the mold sections when the cooperating mold cavities are properly aligned;

conveying the cooperating mold sections along a predetermined path of travel from a mold making machine to a mold pouring station; and measuring with a non-contact distance measuring means located adjacent the path of travel of the mold sections the distanc to an area on the surface of the mold sections where the reference marks are located and detecting any step changes in the measured distance to the reference marks of cooperating mold sections so that misalignment of the internal mold cavity of the cooperating mold sections can be detected.

* * * * *

UNITED STATES PATENT AND TRADEMARK OFFICE

CERTIFICATE OF CORRECTION

PATENT NO. : 4,724,886

DATED : February 16, 1988

INVENTOR(S) : Eric J. Sjodahl

It is certified that error appears in the above-identified patent and that said Letters Patent is hereby corrected as shown below:

Column 5, line 61, "whihc" should be -- which --.

Column 6, lines 36 and 37, "cavitites" should be -- cavities --.

Column 6, line 38, "sectiosn" should be -- sections --.

Column 8, line 8, "distanc" should be -- distance --.

Signed and Sealed this

Fourth Day of October, 1988

*Attest:*

*Attesting Officer*

DONALD J. QUIGG

*Commissioner of Patents and Trademarks*